US007184562B2

(12) United States Patent
Seki et al.

(10) Patent No.: US 7,184,562 B2
(45) Date of Patent: Feb. 27, 2007

(54) LOUDSPEAKER APPARATUS

(75) Inventors: Hideki Seki, Saitama (JP); Makoto Yamagishi, Tokyo (JP)

(73) Assignee: Sony Corporation (JP)

( * ) Notice: Subject to any disclaimer, the term of this patent is extended or adjusted under 35 U.S.C. 154(b) by 585 days.

(21) Appl. No.: 10/482,324

(22) PCT Filed: Jul. 9, 2002

(86) PCT No.: PCT/JP02/06957

§ 371 (c)(1),
(2), (4) Date: Dec. 29, 2003

(87) PCT Pub. No.: WO03/007653

PCT Pub. Date: Jan. 23, 2003

(65) Prior Publication Data

US 2004/0190746 A1 Sep. 30, 2004

(30) Foreign Application Priority Data

Jul. 9, 2001 (JP) ..... 2001-208351

(51) Int. Cl.
*H04R 25/00* (2006.01)
*H04R 1/02* (2006.01)
*H04R 1/20* (2006.01)

(52) U.S. Cl. ..... 381/160; 381/345; 181/191

(58) Field of Classification Search ..... 381/345, 381/349–350, 160, 386, 388, 306, 333; 181/155–156, 181/150, 175–176, 191, 199; 681/681–683
See application file for complete search history.

(56) References Cited

U.S. PATENT DOCUMENTS 4,475,620 A * 10/1984 Carlsson ..... 181/146
4,701,951 A * 10/1987 Kash ..... 381/304
5,920,637 A * 7/1999 Jeon ..... 381/388
6,996,243 B2 * 2/2006 Welker et al. ..... 381/160

FOREIGN PATENT DOCUMENTS

JP 2-241196 A * 9/1990
JP 2-241198 A * 9/1990
JP 6-078392 * 3/1994

* cited by examiner

*Primary Examiner*—Curtis Kuntz
*Assistant Examiner*—Phylesha L Dabney
(74) *Attorney, Agent, or Firm*—Lerner, David, Littenberg, Krumholz & Mentlik, LLP

(57) ABSTRACT

A loudspeaker apparatus in which sound from a loudspeaker is emitted from a top surface of a loudspeaker cabinet, wherein the top surface is slanted obliquely backward and in which a sound reflecting panel is mounted such that that the panel can swing on the rear plate of the loudspeaker cabinet, so that the emitted sound is reflected by the panel toward the listener.

20 Claims, 8 Drawing Sheets

10L(10R)
2L(2R)
1L(1R)
18
19
20
21
25
8L(8R)
H

10L(10R)
2L(2R)
1L(1R)
18
19
20
21
25

LOUDSPEAKER APPARATUS

TECHNICAL FIELD

The present invention relates to a loudspeaker apparatus in which a sound reflecting panel is mounted such that the panel can swing on the rear surface of a loudspeaker cabinet or the like, and particularly to a loudspeaker apparatus in which sound is emitted obliquely backward from a loudspeaker unit to be heard after reflecting on the panel.

BACKGROUND ART

As shown in FIG. 11, in widely used conventional loudspeaker cabinets and the like of stereos or the like, left and right loudspeakers 2L and 2R which are incorporated in left and right loudspeaker cabinets 1L and 1R are placed in front of a listener 3, and left and right opening portions 4L and 4R made on baffle plate sides of the left and right loudspeaker cabinets 1L and 1R are placed opposing to the listener 3.

Thus, a L sound from the left loudspeaker 2L first reaches the left ear 5L of the listener 3, and a L' sound, the same sound as a L sound, subsequently reaches the right ear 5R after a short delay; similarly, an R sound emitted from the right loudspeaker 2R first reaches the right ear 5R that is near the right loudspeaker 2R, and an R' sound subsequently reaches the left ear 5L after a predetermined delay. Consequently, the listener 3 having a pathway that blends the auditory senses of both the listener's ears feels the localization point 6 of the sound sources L and R being ahead of him/her. Therefore, localization sensation with respect to the sound sources is relatively well.

Also, as shown in FIG. 12B, in conventional loudspeaker cabinets, left and right loudspeaker apparatuses 10L and 10R, whose operationality are improved by arranging on front panels 25 of the loudspeaker cabinets 1L and 1R operating knobs such as a power switch 18 for turning on/off the power, a volume 19 for adjusting the sound volume, a bass volume 20 for controlling volume of sounds in bass range, an input switching volume 21 and the like, has a problem in which a compact stereo system can not be obtained, because the surface area of the front panels 25 of the loudspeaker cabinets 1L and 1R is made to be large for providing the left and right loudspeakers 2L and 2R above the operating knobs, which causes the left and right loudspeaker apparatuses 10L and 10R to be larger in direction H of height than a later described loudspeaker apparatuses 2L and 2R of the present invention shown in FIG. 12A. It may be possible to arrange the operating knobs on the top plate or on the left and right side plates of the loudspeaker cabinets 1L and 1R; however, also in this case, the surface area of the top plate or the left and right side plates are made to be large and a problem of user-unfriendliness occurs.

In order to solve the above-mentioned problems, according to the present invention there are obtained left and right loudspeaker apparatuses which have high operationality and can be small-sized by emitting sound obliquely backward from the opening portions of the left and right loudspeakers in the left and right loudspeaker cabinets, so that a listener can listen to the reflected sound that has reflected on sound reflecting panels provided on the rear surfaces of the loudspeaker cabinets; and further in order to solve problems in which, as explained with reference to the left and right loudspeaker cabinets 1L and 1R in FIG. 11, the opening portions 4L and 4R of the left and right loudspeakers 2L and 2R directly opposing to the listener 3 makes the listener 3 feel a sense of pressure caused by acoustic pressure, and makes the listener 3 difficult to feel a sense of sound widely extending, because the sound image localization point 6 is localized near to the listener 3 halfway between the left and right loudspeaker cabinets 1L and 1R and the listener 3, in the present invention there are provided loudspeaker apparatuses in which the shape of the sound reflecting panels is determined to make it possible to easily control directional characteristics of sound and which have sound reflecting panels that allow no sound to leak from behind the rear surface.

DISCLOSURE OF THE INVENTION

According to the present invention, there is obtained a loudspeaker apparatus in which an opening portion of a loudspeaker is provided on the oblique rear portion thereof, and opposing to the opening portion, as a sound reflecting panel of a loudspeaker cabinet in which a loudspeaker is provided, a sound reflecting panel that reflects sound forward is mounted such that the sound reflecting panel can swing, so that the position of the sound source is localized away from the listener and sound widely extends, whereby a sense of pressure caused by acoustic pressure is lessened, and since the loudspeaker is not positioned at the front of the loudspeaker cabinet, a number of system control operating portions (knobs) are to be provided to improve operationality, the loudspeaker cabinet can be small-sized, and the opening portion are not seen from the listener side at all to increase freedom with respect to the design.

Further, in the present invention, since the mounting angle of the loudspeakers 2L and 2R provided in oblique directions is set to 45°±15°, opening portions of the loudspeakers are not seen from the front of the loudspeaker cabinets by a listener and there is obtained a loudspeaker apparatus providing sounds widely extending without a sense of pressure caused by acoustic pressure.

Further, in the present invention, since effective vibratory radius of a loudspeaker is set to 25 mm or less to obtain the loudspeaker for mid-high sounds, it is possible to obtain a loudspeaker apparatus with a compact loudspeaker cabinet capable of reducing fluctuation in the mid and high frequency ranges by resonating with a sound reflecting panel.

Further, in the present invention, since a system control operating portion is provided at the front surface of the loudspeaker cabinet and the sound reflecting panel is mounted on the cabinet in a detachable manner so that the panel can swing, there is obtained a loudspeaker apparatus capable of reproducing the acoustic pressure frequency characteristics up to the high range without fluctuation by resonating with the sound reflecting panel.

Furthermore, in the present invention, since a subwoofer which incorporates an amplifier is coupled with and added to the right and left loudspeaker apparatuses provided with the sound reflecting panels, the audio reproducing apparatus including loudspeaker apparatuses capable of reproducing the acoustic pressure frequency characteristics from the low range to the high range without fluctuation can be constructed.

BEST MODE FOR CARRYING OUT THE INVENTION

Hereinafter, with reference to FIGS. 1 to 9, a loudspeaker apparatus showing an embodiment of the present invention will be described in detail.

Figure 1:
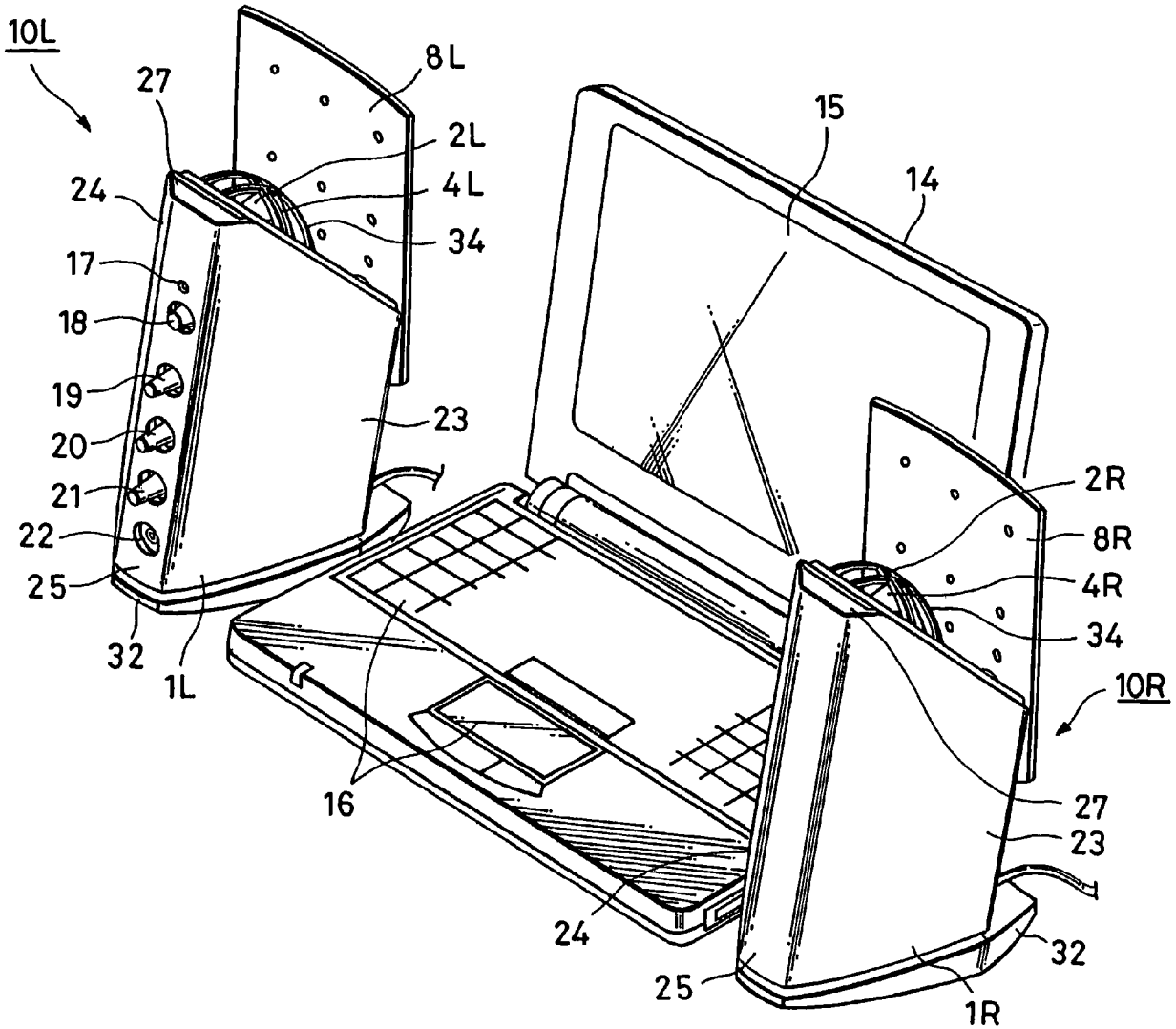
FIG. 1 is a perspective view showing an embodiment of a loudspeaker system of the present invention.

FIG. 1 is a perspective view showing an embodiment of a loudspeaker system including loudspeaker apparatuses of the present invention in which sound reflecting panels are attached to loudspeaker cabinets.

In FIG. 1, loudspeaker apparatuses 10L and 10R composed of left and right loudspeaker cabinets 1L and 1R and left and right sound reflecting panels 8L and 8R are used as a loudspeaker system for a personal computer (hereinafter described as PC), and have a construction in which the left and right loudspeaker apparatuses 10L and 10R set on the left and right sides of a notebook PC 14 emit a sound signal, which is input to the PC 14, obliquely backward from the left and right loudspeaker cabinets 1L and 1R in the directions of the left and right sound reflecting panels 8L and 8R through the opening portions 4L and 4R that incorporate open left and right loudspeakers 2L and 2R and then the sound signal is reflected on the left and right sound reflecting panels 8L and 8R to be emitted in the front direction of the loudspeaker apparatuses 10L and 10R where a listener 3 (refer to FIG. 11) exists.

The PC 14 comprises like a conventional device a display apparatus 15 such as an LCD (Liquid Crystal Display) that takes in a video signal to be displayed, and an operating portion 16 such as a keyboard, a mouse and others.

With respect to the loudspeaker apparatuses 10L and 10R in this embodiment, on the front panel side of the left loudspeaker cabinet 1L constituting the left loudspeaker apparatus 10L, an LED 17 showing an operation state, a power on/off switch 18, variable resisters (VRs) 19, 20 and 21 for volume, bass and input switching, a headphone jack 22, and the like are set in sequence, so that the various knobs are disposed to be easily adjusted by the listener 3 when he/she listens to an audio signal or a sound signal.

Figure 2B:
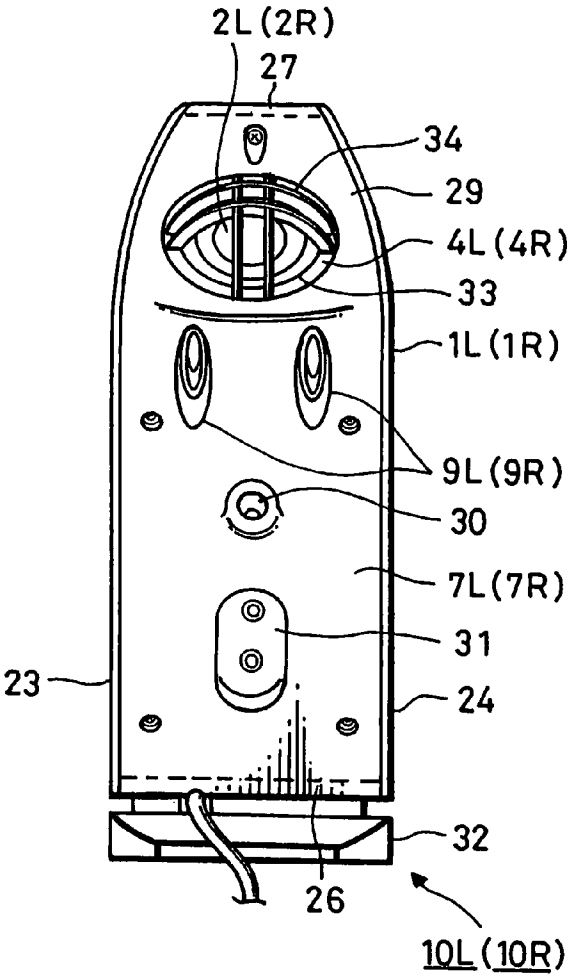
FIGS. 2A and 2B are side and rear views of a loudspeaker apparatus used in the present invention.
Figure 2A:
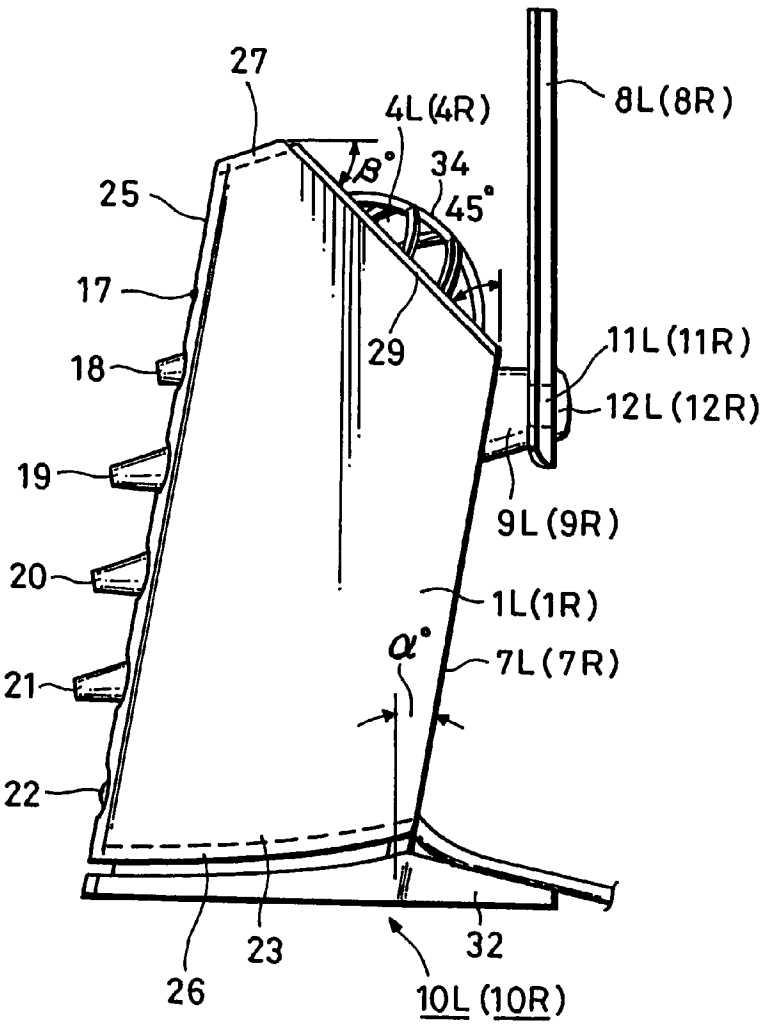

FIGS. 2A and 2B show side and rear views of the above-mentioned left and right loudspeaker apparatuses 2L and 2R.

Referring to FIGS. 2A and 2B, the construction of the left and right loudspeaker apparatuses 10R and 10R in the present invention is specifically explained.

First, in FIG. 2B, the left and right loudspeaker cabinets 1L and 1R have horizontal U-shaped cross section when seen from a plane, and are composed of left and right side plates 23 and 24, a front panel 25, a bottom plate 26 and an top plate 27 to constitute a box-like shape with a synthetic resin or the like, wherein the front panel 25 is shaped approximately like a 25 mm×145 mm rectangle, for example, the top plate 27 is shaped approximately like a trapezoid with a base of 35 mm, a top of 25 mm and a height of 10 mm approximately, the bottom plate 26 is shaped approximately like a triangle, whose apex angle is cut off by 25 mm that is equivalent to the length of the shorter side of the front panel 25, with a base of 45 mm and the other two sides, each of which is 65 mm, approximately, and the left and right side plates 23 and 24 are made to broaden from the front to the rear with a predetermined curvature and have a depth of about 65 mm; and as shown in FIG. 2A, with respect to the direction of height, the loudspeaker cabinets incline toward the back by a predetermined angle $\alpha°$, such as 10°, for example, and the upper edges of the left and right side plates 23 and 24 incline toward the bottom in the back direction from the ends of the top plates 27 at a predetermined angle $\beta°$ and form an angle of 45° with perpendicular lines set at the ends of rear plates 7L and 7R.

On the other hand, each of the rear plates 7L and 7R is shaped approximately like a rectangle of about 95 mm×55 mm, and on the upper parts of the rear plates 7L and 7R, attachment portions 9L and 9R each consisting of two pieces, which mount the left and right sound reflecting panels 8L and 8R such that the sound reflecting panels can swing, are integrally formed with the rear plates 7L and 7R.

Numeral 30 denotes an air vent for constructing a vented baffle, numeral 31 denotes an input terminal for a sound signal from the PC 14 or the like, and the air vent 30 and the input terminal 31 are also integrally constructed with the rear plates 7L and 7R using a synthetic resin.

Figure 3:
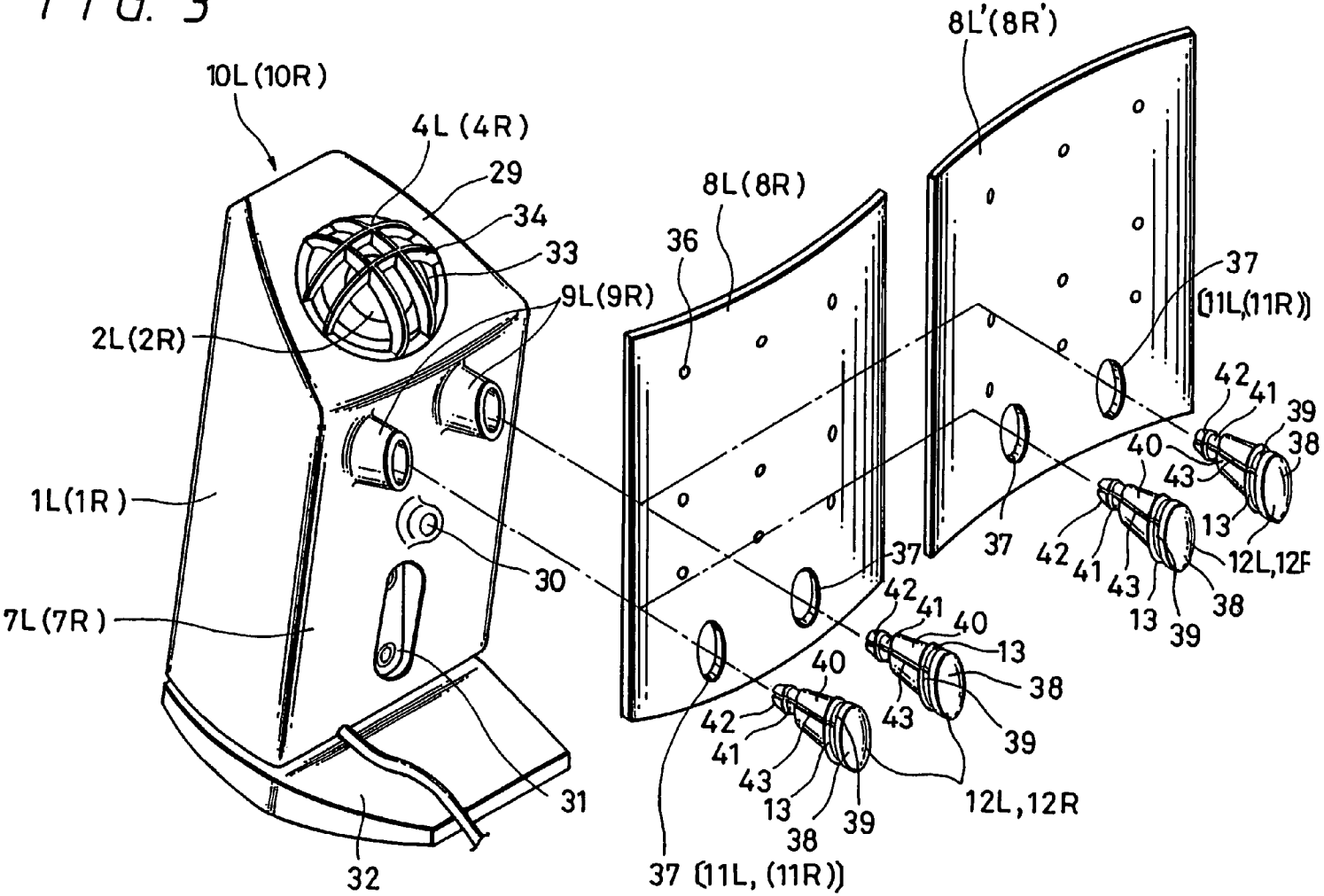
FIG. 3 is a perspective view explaining a manner of attaching an attachment device for a sound reflecting panel of the present invention.
Figure 4:
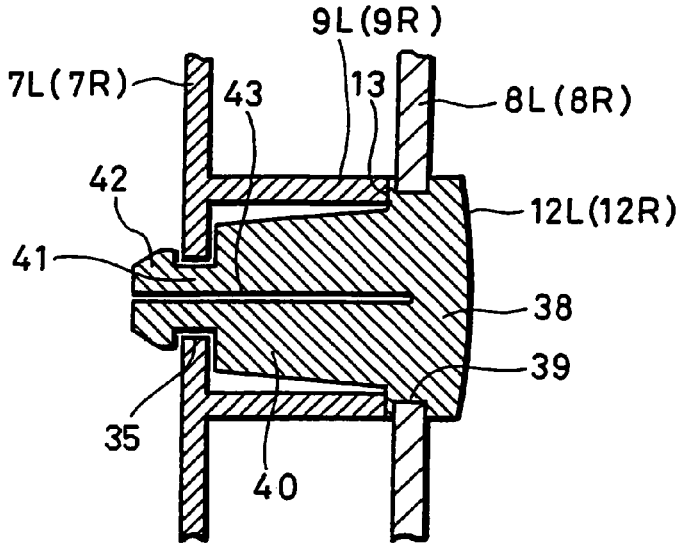
FIG. 4 is a sectional side view of a joining member showing an embodiment of an attached state of a sound reflecting panel of the present invention.

As shown in FIGS. 2B, 3 and 4, the attachment portions 9L and 9R each consisting of two pieces, which have been integrally formed with the rear plates 7L and 7R, have protruding bosses, each of which is shaped like approximately an elliptical cylinder, and the rear plates 7L and 7R at the elliptical cylinder-shaped ends are also perforated with elliptical holes 35 (refer to FIG. 4).

As is obvious from FIGS. 2A, 2B and 3, a baffle board 29 is shaped approximately like a trapezoid when seen from the front, in which the trapezoid-shaped inclined portion has a curvature of being raised outward, the base of the trapezoid has a length of 55 mm that is the same as the length of the short sides of the rear plates 7L and 7R, the upper side of the trapezoid has a length of 35 mm that is the same as the length of the base of the top plate 27, the height is selected to be approximately 65 mm, and the baffle boards 29 are integrally formed with the rear plates 7L and 7R with a synthetic resin and are bent in an elbow-like shape, as shown in vertical cross section of FIG. 2A, to be inclined at 45° with respect to a perpendicular line to a base 32 placed on a level surface such as a desk as shown in FIG. 2A.

The opening portions 4L and 4R provided approximately at the center of the trapezoid-shaped portions of the baffle boards 29 are perforated with through-holes 33 for the left and right loudspeakers 2L and 2R, dome-shaped guards 34 are integrally constructed with the baffle boards 29 in such a manner that the plates cover these through-holes 33, and the left and right loudspeakers 2L and 2R are fixed on the inside of the baffle boards 29 opposing to the through-holes 33. The above baffle boards 29 and the rear plates 7L and 7R in the shape of an elbow are fastened with screws or the like to approximately box-shaped chassis which are composed of the left and right side plates 23 and 24, the bottom plates 26 and the top plates 27. Further, the bases 32 are also fixed to the bottom plates 26 of these chassis to constitute the left and right loudspeaker cabinets 1L and 1R.

As a matter of course, in the left loudspeaker cabinet 1L, there are provided a preamplifier, drive circuits and control circuits, which drive and control the LED 17, each of the variable resisters (VRs) 19, 20 and 21, the headphone jack 22 and the like.

Here, as shown in FIG. 1, the right loudspeaker cabinet 1R has no operating knobs of various kinds, LED or the like on the front panel 25. These operating knobs, an amplifier and the like may be provided on the right loudspeaker cabinet 1R as a matter of course.

Referring to FIGS. 3 and 4, there will be described the manner in which the above-mentioned left and right loudspeaker cabinets 1L, 1R and the sound reflecting panels 8L, 8R are attached.

As shown in FIG. 3, each of the sound reflecting panels 8L and 8R is formed with a transparent synthetic resin of about 2 mm in thickness and approximately 95 mm×70 mm in rectangular shape with an embossed effect to be either a flat plate, or a concave-shaped plate that has a predetermined curvature. Further, at the lower parts of the sound reflecting panels 8L and 8R, there are formed attachment portions 11L and 11R having the same dimensions as the attachment portions 9L and 9R each consisting of two pieces on the rear plates 7L and 7R. These attachment portions 11L and 11R may be elliptical through-holes 37 formed at the lower parts of the sound reflecting panels 8L and 8R. It is noted that in FIG. 3 numeral 36 denotes a part not embossed, and though in this embodiment the part is shown as a small circle, other forms than the circle can also be selected accordingly and this part is a transparent part.

Next, there will be explained joining members 12L and 12R which joins the sound reflecting panels 8L and 8R to the attachment portions 9L and 9R of the loudspeaker cabinets 1L and 1R, and the manner of attaching thereof, as shown in FIGS. 1 and 2A.

The joining members 12L and 12R are formed of resilient, shock-absorbing synthetic rubber, natural rubber or the like and formed as shown in FIGS. 3 and 4. Specifically, the front parts thereof are made to be pull-out preventing portions 38 in approximately elliptical shape, serving as shock-absorbing portions in case the sound reflecting panels 8L and 8R fall off the attachment portions 9L and 9R.

Next to the pull-out preventing portions 38, there are provided integrally formed portions of: engaging portions 39 subsequent to the above pull-out preventing portions 38, which is shaped like an ellipse to have the same thickness as the thickness t (t=2 mm, for example) of the sound reflecting panels 8L and 8R for engaging with the elliptical through-holes 37 made on the sound reflecting panels 8L and 8R, flange portions 13 in elliptical shape further subsequent to the engaging portions 39, which hold the sound reflecting panels 8L and 8R with the pull-out preventing portions 38, press-fitting portions 40 which are shaped like a ellipse that narrows toward its end to be pressed into the elliptical cylinders of the attachment portions 9L and 9R of the rear plates 7L and 7R of the loudspeaker cabinets 1L and 1R, and together with the flange portions 13 prevent sound leaked from the elliptical holes 35 made on the rear plates 7L and 7R (refer to FIGS. 4A and 4B), neck portions 41 which are shaped like an ellipse in cross section and inserted into the elliptical holes 35 made on the rear plates 7L and 7R, and hooking portions 42 which are pressed into the elliptical holes 35 made on the rear plates 7L and 7R as changing the shape by being pressed, and then slot grooves 43 for adding resilience are formed in the direction from the hooking portion 42 toward the engaging portion 39.

With respect to the above joining members 12L and 12R, as shown in FIG. 3, the curvature of the sound reflecting panels 8L and 8R is set to bent inward (hereinafter described as concave type) when seen from the front panels 25 side of the left and right loudspeaker apparatuses 10L and 10R; then the joining members 12L and 12R each consisting of two pieces are inserted into the through-holes 37 of the sound reflecting panels 8L and 8R to be engaged with the through-holes 37 by means of the engaging portions 39, and the press-fitting portions 40 of the joining members 12L and 12R are pressed along with the sound reflecting panels 8L and 8R to be inserted into the elliptical cylinders of the attachment portions 9L and 9R of the loudspeaker cabinets 1L and 1R; and when the hooking portions 42 at the ends are pressed to enter the elliptical holes 35 on the rear plates 7L and 7R as being bent, after the neck portions 41 is inserted into the elliptical holes 35 as shown in FIG. 4, the hooking portions 42 at the ends open upward and downward to hold the neck portions 41 in the elliptical holes 35, not letting the sound reflecting panels 8L and 8R detach easily even if the sound reflecting panels 8L and 8R are intentionally pulled out or pushed into, thereby the sound reflecting panels 8L and 8R being prevented from falling off. Further, sounds leaked from the loudspeaker cabinets 1L and 1R can be completely blocked by the flange portions 13 and the press fitting portions 40, and in case the sound reflecting panels 8L and 8R are overloaded, for example, when the loudspeaker cabinets 1L and 1R fall down, the sound reflecting panels 8L and 8R are detached from the loudspeaker cabinets 1L and 1R so that the sound reflecting panels 8L and 8R are prevented from breaking.

In the above-described manner of attaching the sound reflecting panels 8L and 8R, the sound reflecting panels 8L and 8R are concave in shape when seen from the front panels 25 side of the left and right loudspeaker apparatuses 10L and 10R. However, joining members 12L and 12R may be inserted into the through-holes 37 which are the attachment portions 11L and 11R of the sound reflecting panels 8L' and 8R' as shown on the right side of FIG. 3, in the direction in which the sound reflecting panels bent outward (hereinafter described as convex type), and thus pressed to be inserted into the attaching portions 9L and 9R of the loudspeaker cabinets 1L and 1R.

Figure 6A:
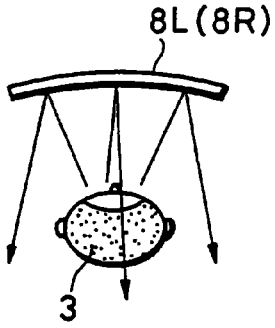
FIGS. 6A and 6B are views showing the change of a sound image according to the difference in the attached form of a sound reflecting panel.
Figure 6B:
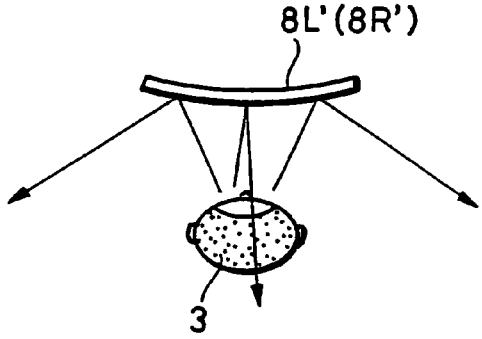
Figure 11:
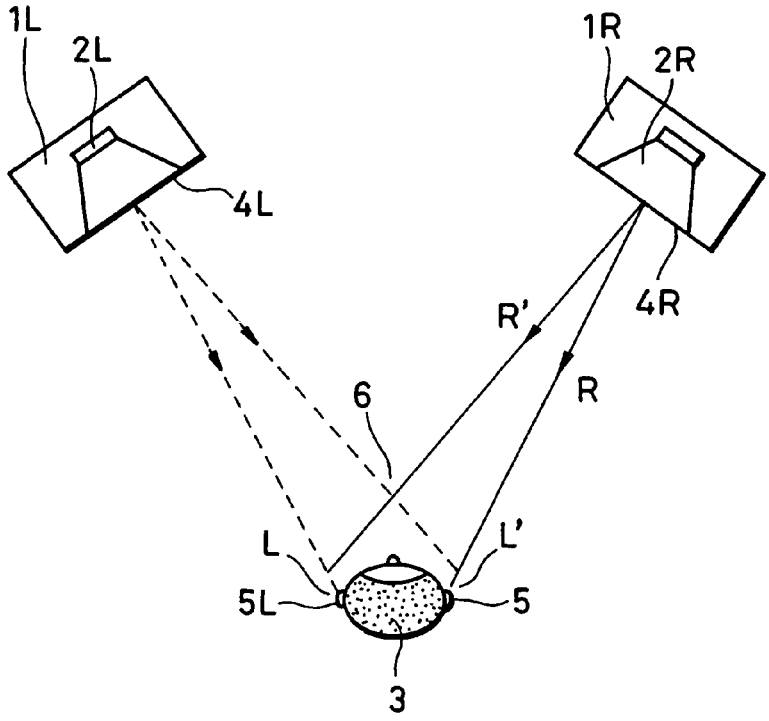
FIG. 11 is a view for explaining localization of a sound image of a conventional loudspeaker system.
Figures 12A, 12B:
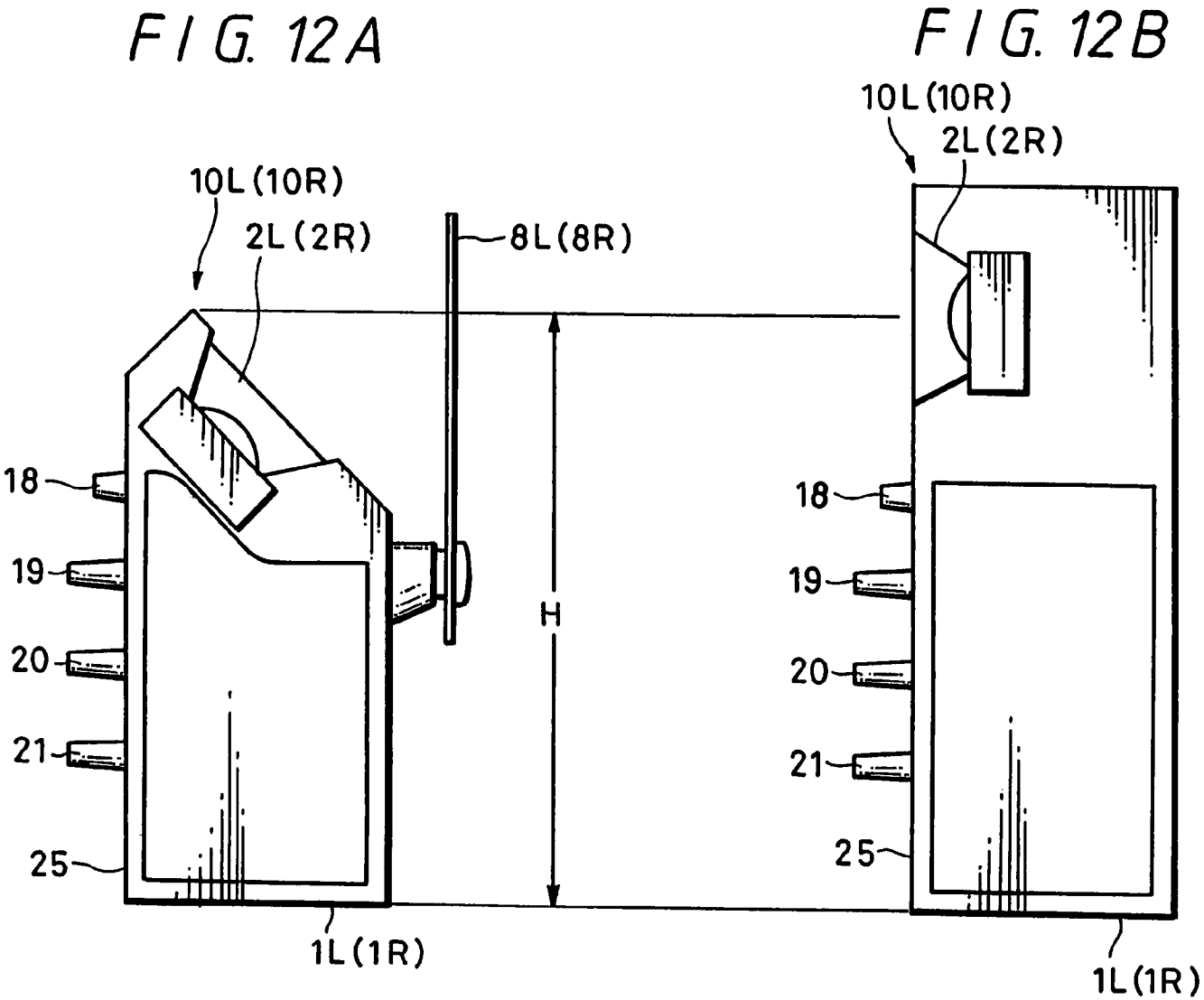
FIG. 12 is a view comparing a loudspeaker apparatus of the present invention with a conventional loudspeaker apparatus.

FIG. 6 is a schematic view which shows extending sounds when the sound reflecting panels 8L and 8R are concave in shape and the sound reflecting panels 8L' and 8R' are convex in shape, and when the sound reflecting panels are either concave or convex as shown in FIGS. 6A and 6B, sound image localization points 6 are localized away from the listener 3, so that it becomes possible to obtain a sound signal having sense of depth in comparison with the conventional stereo system shown in FIG. 11, in which the opening portions 4L and 4R are provided at the front of the loudspeakers 1L and 1R. Therefore, when the concave-shaped sound reflecting panels 8L and 8R are turned over to be the convex-shaped sound reflecting panels, as shown in FIG. 6B, it is possible to easily make a sound image reflected on the sound reflecting panels 8L' and 8R' wide-ranging in comparison with that reflected on the concave sound reflecting panels 8L and 8R.

Figure 5:
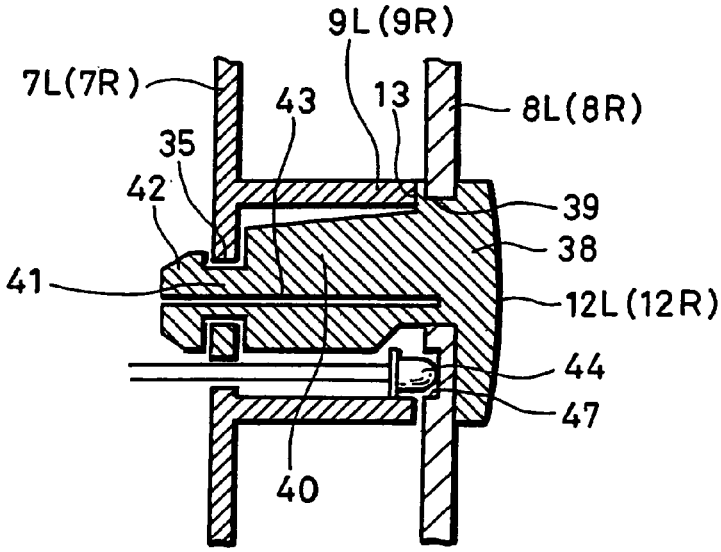
FIG. 5 is a cross-sectional view of a joint showing another embodiment of an attached state of a sound reflecting panel of the present invention.

FIG. 5 shows the construction in which ends of light emitting elements 44, such as an LED pass through the elliptical holes 35 of the attachment portions 9L and 9R provided on the rear plates 7L and 7R of the loudspeaker cabinets 1L and 1R shown in FIG. 4, to be set opposed to the inside of holes 47 made on the sound reflecting panels 8L and 8R, and although the construction in which a part of the joining members 12L and 12R is removed is shown in this case, the ends of the light emitting elements 44 may be led from through-holes made at predetermined positions on the rear plates 7L and 7R such that the ends of the light emitting elements 44 are in contact with the sound reflecting panels 8L and 8R. In this case, in order to prevent sound leaked from the through-holes made on the rear plates 7L and 7R, bushings may be placed. Also, the light emitting elements 44 may be led out through the passage vent 30 for phase inversion.

When the above light emitting element 44 is employed instead of the LED 17 displaying an operation state of a loudspeaker apparatus, or employed as lighting or to light up the design on the sound reflecting panels 8L and 8R, further an artistic effect can be obtained.

As described above, when the light emitting elements 44 are brought in contact with the sound reflecting panels 8L, 8R, 8L' and 8R' to light up, the peripheries of the sound reflecting panels 8L, 8R, 8L' and 8R' can be lit in a predetermined color. Also, designs and the like on other areas than the embossed portions can be lit up.

Figure 7:
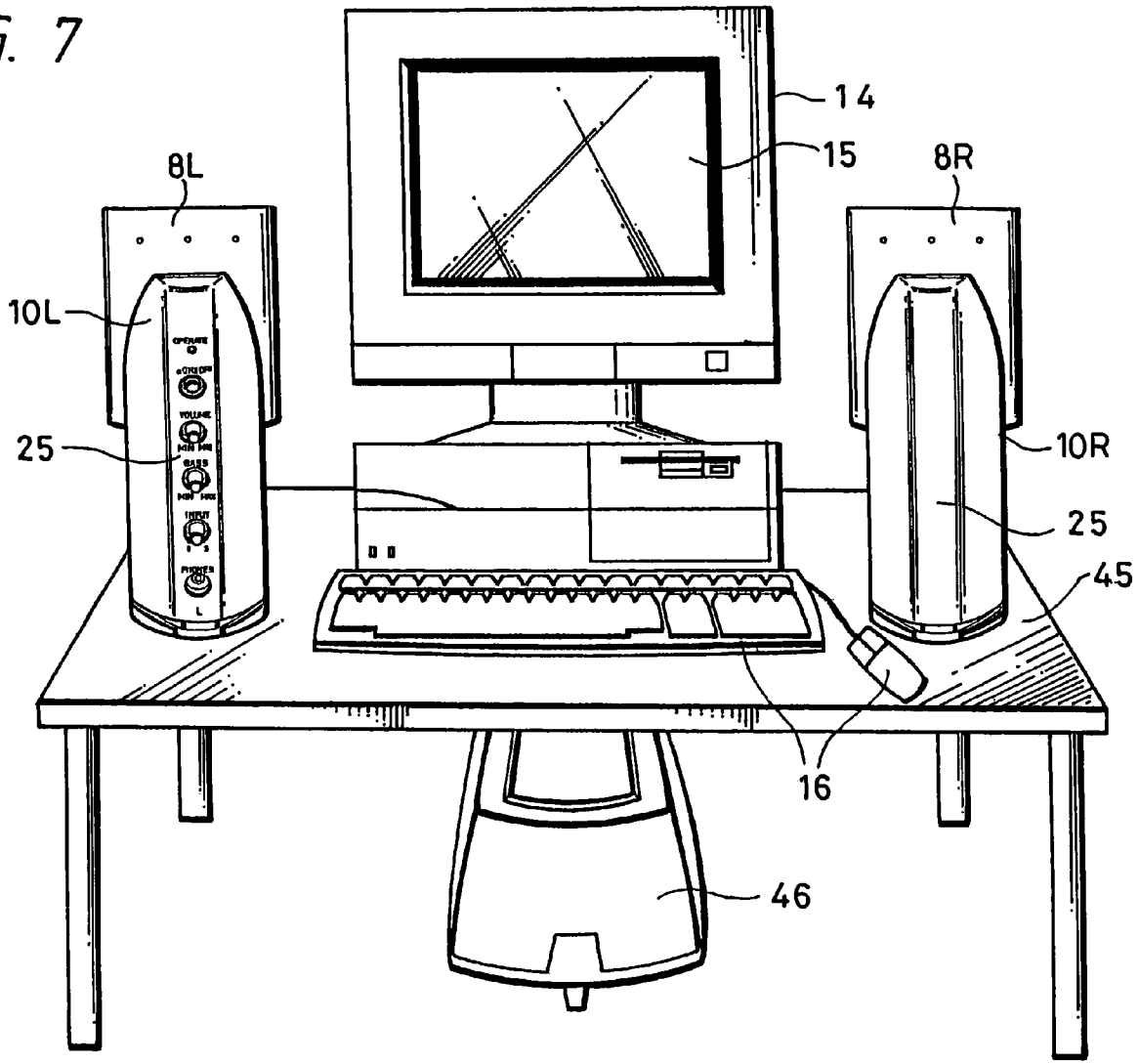
FIG. 7 is a perspective view showing another embodiment of a loudspeaker system of the present invention.

FIG. 7 shows another embodiment of the construction of loudspeaker system according to the present invention. On a table 45, the left and right loudspeaker apparatuses 10L and 10R that incorporate the left and right mid-high sound loudspeakers 2L and 2R are placed and connected to the PC 14 similarly to the system shown in FIG. 1.

Moreover, when a system in which a subwoofer 46 that incorporates an amplifier and the like is provided under the table 45 to emit low-frequency sound components from the subwoofer is employed, it is possible to turn on the system power and adjust the lower range of the woofer only by the operation system provided on the front panel 25 of the left loudspeaker apparatus 10L without difficulties, and it is also possible to reduce the space required for the system on the table.

Figure 8:
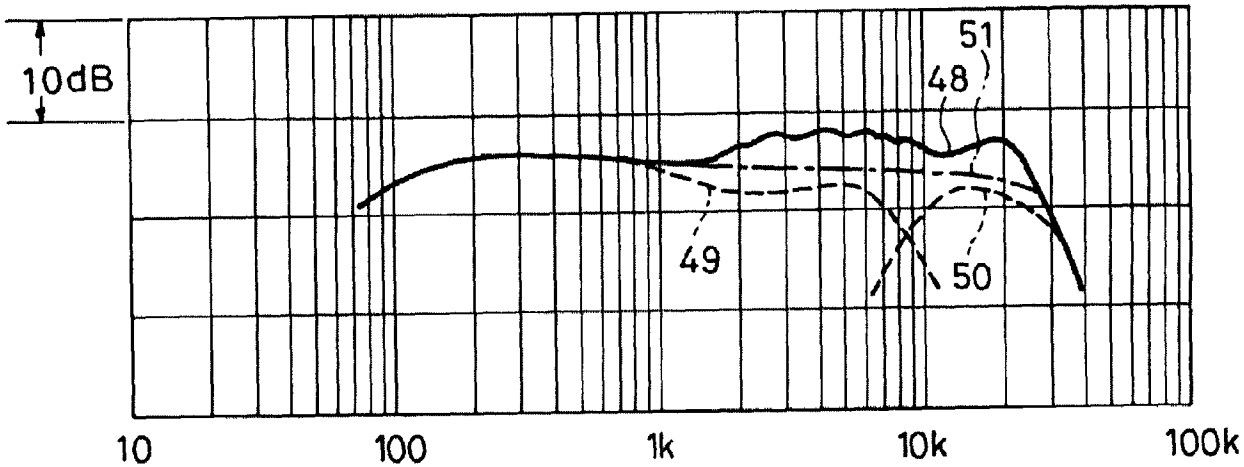
FIG. 8 shows frequency characteristic curves of a loudspeaker apparatus of the present invention.

FIG. 8 shows frequency characteristic curves obtained in the case where mid-high sound loudspeakers of 39 ϕmm in diameter and an effective vibratory radius (radius from the center of the diaphragm to the edge) of 15 mm are used for the loudspeakers of the left and right loudspeaker apparatuses 10L and 10R of the loudspeaker system explained in FIG. 7.

In FIG. 8, a frequency characteristic curve 48 shows an overall characteristic at an angle of 0° (the front), a frequency characteristic curve 49 shows a frequency characteristic at an angle of 135° in the case where the sound reflecting panels 8L and 8R are provided without inclining backward as shown in FIG. 1, and a frequency characteristic curve 50 shows a frequency characteristic whose high-frequency component is extended by the sound reflected on the sound reflecting panels 8L and 8R. Accordingly, the overall characteristic curve, such as that of numeral 51, of the loudspeaker apparatuses 10L and 10R in which, as shown in FIG. 1 according to the present invention, the sound reflecting panels 8L and 8R are provided on the rear plates 7L and 7R and the sound is emitted at an angle of 135° shows that high range can be extended to approximately from 5 kHz to 20 kHz in high frequency range, and therefore the system covers the mid-high sound range that is approximately from 200 Hz to 20 kHz.

Figure 9:
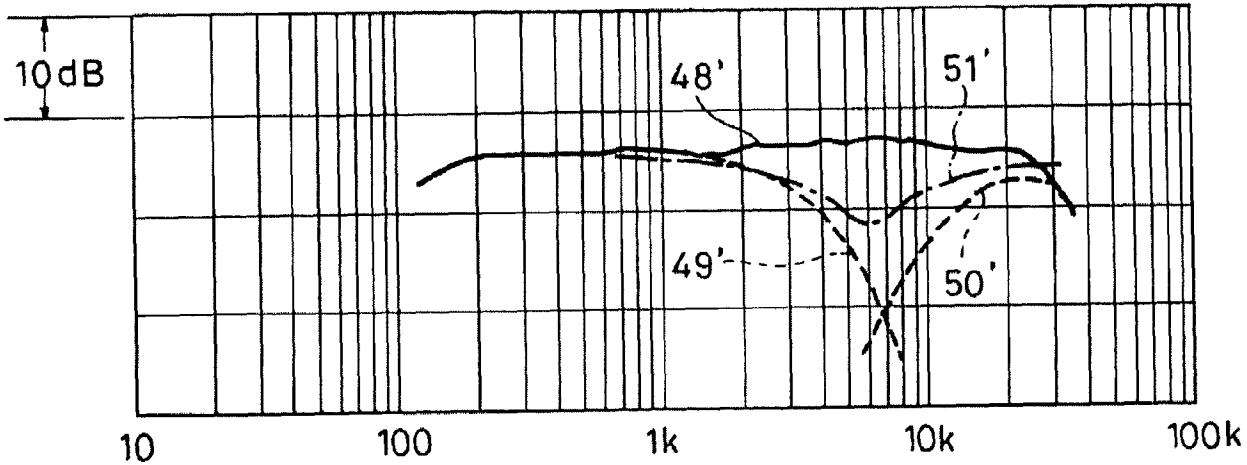
FIG. 9 shows other frequency characteristic curves of a loudspeaker apparatus of the present invention.

FIG. 9 shows frequency characteristic curves obtained in the case where the loudspeaker apparatuses 10L and 10R of 39 ϕmm in diameter and an effective vibratory radius of 25 mm are used, and a frequency characteristic curve 48' shows a frequency characteristic at an angle of 0°, a frequency characteristic curve 49' shows a frequency characteristic without providing the sound reflecting panels 8L and 8R, which begins to drop sharply at about 3 kHz and a dip at the part linked to a frequency characteristic curve 50' of reflected sounds from the sound reflecting panels 8L and 8R occurs at around 5 kHz to 6 kHz, however reproduction range of the frequency ranges from approximately 200 Hz to 20 kHz and the dip can be reduced to 2 dB to 3 dB.

Figure 10:
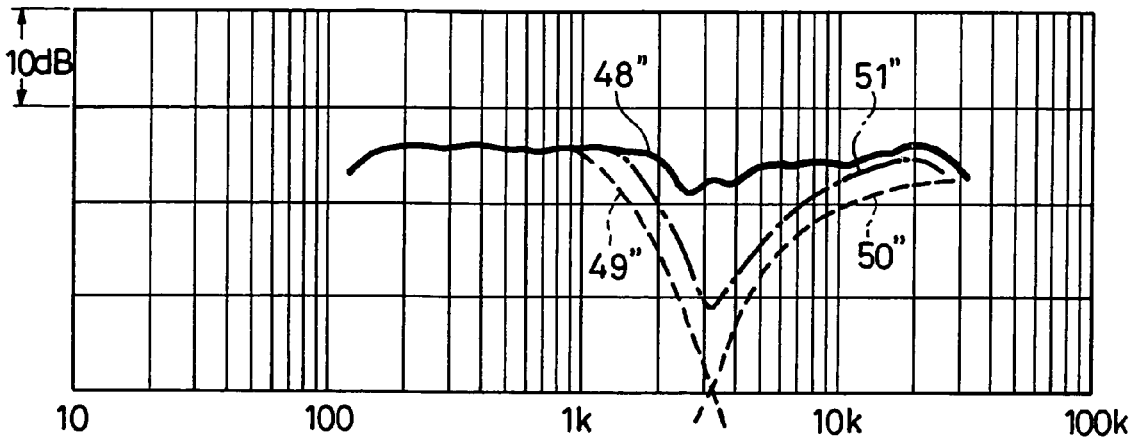
FIG. 10 is a frequency characteristic view when a loudspeaker apparatus of the present invention is applied to a loudspeaker whose diameter is large.

FIG. 10 shows a frequency characteristic curves obtained in the case where the loudspeaker apparatuses of 130 ϕmm in diameter and an effective vibratory radius of 50 mm are used, and a frequency characteristic curve 49" obtained in the case of without providing the sound reflecting panels 8L and 8R begins to drop at about 15 kHz, and a dip at the part linked to a frequency characteristic curve 50" of the sound reflected on the sound reflecting panels 8L and 8R occurs greatly at around 2 kHz to 3 kHz as shown by an overall characteristic curve 51". This is because directivity is generated when the diameter of a loudspeaker becomes larger.

In light of the above-mentioned frequency characteristic curves, it is understood that a loudspeaker apparatus in which an effective vibratory radius is equal to or less than 25 mm and the oblique angle of the opening portion is approximately 45°±15° is efficient.

According to the above-mentioned loudspeaker apparatus of the present invention, the following effectiveness will be obtained:

1. Since the position of a sound source is localized away from a listener, a sense of pressure caused by acoustic pressure is lessened and sound which widely extends (providing sense of depth) is obtained.
2. Since a loudspeaker is not positioned at the front of a loudspeaker cabinet, which allows many system control operating portions (knobs) to be set up, operationality is improved and the loudspeaker cabinet can be smaller sized.
3. The directivity of sound can be easily controlled depending on setting of the form of sound reflecting panels.
4. The design of a loudspeaker apparatus can be freely selected such that the loudspeaker is not seen from the listener at all, the sound reflecting panel can be lit up, and so on.
5. A loudspeaker apparatus that allows sound not leaked from behind can be obtained.
6. A loudspeaker apparatus which provides lighting or an artistic effect can be obtained by lighting up sound reflecting panels.

INDUSTRIAL APPLICABILITY

According to the present invention, a loudspeaker apparatus that is suitable for use in a mid-high sound loudspeaker system added to a mobile or stationary PC, or for use in a loudspeaker system for an acoustic reproduction apparatus can be obtained.

The invention claimed is:

1. A loudspeaker apparatus comprising:

a loudspeaker cabinet having a loudspeaker mounted therein, wherein an opening portion of the loudspeaker cabinet is provided in an upper surface of the loudspeaker cabinet obliquely at the back thereof, and a sound reflecting panel that reflects sounds forward relative to the back is mounted such that the sound reflecting panel can swing on a rear plate of the loudspeaker cabinet.

2. The loudspeaker apparatus according to claim 1, wherein a mounting angle of said loudspeaker is provided in said upper surface of the loudspeaker cabinet s set to 45°±15°.

3. The loudspeaker apparatus according to claim 1, wherein said loudspeaker is a mid-high sound loudspeaker having an effective vibratory radius of 25 mm or less.

4. The loudspeaker apparatus according to claim 2, wherein said loudspeaker is a mid-high sound loudspeaker having an effective vibratory radius of 25 mm or less.

5. The loudspeaker apparatus according to claim 1, wherein a system control operating portion is provided at a front surface of said loudspeaker cabinet, and further comprising means for mounting said sound reflecting panel in a detachable manner on the rear plate of said loudspeaker cabinet.

6. The loudspeaker apparatus according to claim 2, wherein a system control operating portion is provided at a front surface of said loudspeaker cabinet, and further comprising means for mounting said sound reflecting panel in a detachable manner on the rear plate of said loudspeaker cabinet.

7. The loudspeaker apparatus according to claim 3, wherein a system control operating portion is provided at a front surface of said loudspeaker cabinet, and further comprising means for mounting said sound reflecting panel in a detachable manner on the rear plate of said loudspeaker cabinet.

8. The loudspeaker apparatus according claim 4, wherein a system control operating portion is provided at a front surface of said loudspeaker cabinet, and further comprising means for mounting said sound reflecting panel in a detachable manner on the rear plate said loudspeaker cabinet.

9. The loudspeaker apparatus according to claim 1, further comprising: a subwoofer incorporating an amplifier.

10. The loudspeaker apparatus according to claim 2, further comprising: a subwoofer incorporating an amplifier.

11. The loudspeaker apparatus according to claim 3, further comprising: a subwoofer incorporating an amplifier.

12. The loudspeaker apparatus according to claim 5, further comprising: a subwoofer incorporating an amplifier.

13. The loudspeaker apparatus according to claim 1, further comprising means for mounting said sound reflecting panel so as to be detachable with respect to said loudspeaker cabinet.

14. The loudspeaker apparatus according to claim 1, wherein said sound reflecting panel is substantially rectangular in shape and formed of a transparent synthetic resin by bending a flat panel into an arcuate shape when seen from a front surface of the loudspeaker cabinet.

15. The loudspeaker apparatus according to claim 1, wherein an embossed pattern is formed on said sound reflecting panel.

16. The loudspeaker apparatus according to claim 1, wherein said sound reflecting panel is mounted through a resilient member on an attachment portion provided on the rear plate of said loudspeaker cabinet such that said sound reflecting panel can swing thereon.

17. The loudspeaker apparatus according to claim 1, wherein the upper surface is inclined toward the rear plate side when seen from the front surface of said loudspeaker cabinet.

18. The loudspeaker apparatus according to claim 1, further comprising a dome-shaped guard provided at the opening portion of the loudspeaker cabinet on a baffle board forming the upper surface of said loudspeaker cabinet.

19. The loudspeaker apparatus according to claim 1, further comprising a light emitting element set opposite to said sound reflecting panel, so that said sound reflecting panel becomes illuminated.

20. The loudspeaker apparatus according to claim 1, further comprising an air vent for providing a vented baffle formed in said rear plate of said loudspeaker cabinet.

* * * * *